US007381371B2

(12) United States Patent
Piacenza et al.

(10) Patent No.: US 7,381,371 B2
(45) Date of Patent: Jun. 3, 2008

(54) PIPETTE DEVICE WITH PIVOTABLE NOZZLE ASSEMBLY

(75) Inventors: Donna A. Piacenza, Chicago, IL (US); Jimmy-Quang Viet Doan, Chicago, IL (US); Michael F. De Rossi, Lindenhurst, IL (US); Stephen J. Gaynes, McHenry, IL (US)

(73) Assignee: Heathrow Scientific LLC, Vernon Hills, IL (US)

( * ) Notice: Subject to any disclaimer, the term of this patent is extended or adjusted under 35 U.S.C. 154(b) by 805 days.

(21) Appl. No.: 10/759,358

(22) Filed: Jan. 16, 2004

(65) Prior Publication Data

US 2005/0158211 A1 Jul. 21, 2005

(51) Int. Cl.
*B01L 3/02* (2006.01)

(52) U.S. Cl. ..... 422/100; 422/100

(58) Field of Classification Search ..... 422/100
See application file for complete search history.

(56) References Cited

U.S. PATENT DOCUMENTS 3,418,097 A 12/1968 Drummond et al.
3,501,964 A 3/1970 Drummond et al.
3,656,351 A * 4/1972 Raczak ..... 73/864.18
3,719,087 A 3/1973 Thiers
3,834,240 A 9/1974 Kenney
3,834,590 A 9/1974 Robinson et al.
3,847,200 A 11/1974 Kopp et al.
3,963,061 A 6/1976 Kenney
D242,729 S 12/1976 Kenney
4,041,764 A 8/1977 Sabloewski
4,063,662 A 12/1977 Drummond et al.
4,099,548 A * 7/1978 Sturm et al. ..... 141/27
4,219,530 A 8/1980 Kopp et al.
4,250,755 A 2/1981 Kenney
D262,319 S 12/1981 Kenney
4,406,170 A 9/1983 Kühn
4,461,328 A 7/1984 Kenney
4,470,317 A 9/1984 Sabloewski
D277,314 S 1/1985 Alvarez et al.
4,527,437 A * 7/1985 Wells ..... 73/864.11
4,624,147 A 11/1986 Kenney
4,659,677 A * 4/1987 Glover et al. ..... 436/174
4,662,545 A 5/1987 Kenney (Continued)

OTHER PUBLICATIONS

Fisher Scientific catalog, Pipet Fillers/Dispensers, pp. 1312-1315 (available prior to Jan. 16, 2004).

(Continued)

*Primary Examiner*—Alexa D. Neckel
*Assistant Examiner*—Imran Akram
(74) *Attorney, Agent, or Firm*—Michael Best & Friedrich LLP

(57) ABSTRACT

The invention provides a pipette device with a pivotable nozzle assembly. The pipette device includes a housing with a barrel portion defining a device axis therethrough. The nozzle assembly includes a pivot mechanism that is rotatably engaged with the housing, and includes pivot bosses that are held captive within a portion of the housing. A pivot selector is slideably retained by a portion of the housing, and is operative to engage and disengage a plurality of indexing holes on the pivot mechanism thereby locking and permitting rotation of the nozzle assembly, respectively.

8 Claims, 3 Drawing Sheets

U.S. PATENT DOCUMENTS 4,734,261 A * 3/1988 Koizumi et al. ..... 422/100
4,760,939 A 8/1988 Ball et al.
D299,065 S 12/1988 Kalmakis et al.
4,815,632 A 3/1989 Ball et al.
4,831,470 A 5/1989 Brunnett et al.
4,896,270 A 1/1990 Kalmakis et al.
4,905,526 A 3/1990 Magnussen, Jr. et al.
4,910,617 A 3/1990 Brunnett et al.
4,926,701 A 5/1990 Tompkins
4,967,606 A 11/1990 Wells et al.
4,988,481 A 1/1991 Jarvimaki et al.
5,002,737 A 3/1991 Tervamaki
5,012,682 A 5/1991 Sabloewski
5,043,106 A 8/1991 Drummond
5,059,398 A 10/1991 Kenney
5,090,255 A 2/1992 Kenney
5,104,625 A 4/1992 Kenney
5,173,266 A 12/1992 Kenney
5,187,990 A 2/1993 Magnussen, Jr. et al.
5,214,968 A 6/1993 Kenney
5,294,405 A 3/1994 Kenney
5,389,341 A 2/1995 Tuunanen et al.
5,403,553 A 4/1995 Heinonen
5,406,856 A 4/1995 Kühn
5,509,318 A 4/1996 Gomes
5,511,433 A 4/1996 Sabloewski et al.
5,531,131 A 7/1996 Sabloewski
D375,798 S 11/1996 Boothby
5,573,729 A 11/1996 Belgardt et al.
5,591,408 A 1/1997 Belgardt et al.
5,616,871 A 4/1997 Kenney
5,620,660 A 4/1997 Belgardt et al.
5,747,333 A 5/1998 Jungmann-Campello et al.
5,770,158 A 6/1998 Eischen et al.
5,844,686 A 12/1998 Treptow
6,090,348 A 7/2000 Steele et al.
6,240,791 B1 6/2001 Kenney
6,253,628 B1 7/2001 Steele et al.
6,734,026 B1 5/2004 Kenney
2002/0012613 A1 1/2002 Scordato et al.
2002/0095998 A1 7/2002 Kriz et al.

OTHER PUBLICATIONS

BD Falcon Express™ Pipet-Aid® Bench-Top-Pipet-Aid®, www.bdbiosciences.com (available prior to Jan. 16, 2004).
Daigger® catalog, Pipettes/Pipet Fillers, pp. 605-607 (available prior to Jan. 16, 2004).
FastPette™ Pipet Controller, www.bioexpress.com (available prior to Jan. 16, 2004).
Scogil Scientific, Inc., Pipetting Aides & Tools, www.scogilscientificinc.com (available prior to Jan. 16, 2004).
Pipetting Aids Macro, www.carl-roth.de (available prior to Jan. 16, 2004).
Safetypette™, Pipette Filler, www.jencons.co.uk/safety.html (available prior to Jan. 16, 2004).
Roth catalog, Pipetus®-micro, p. 197 (available prior to Jan. 16, 2004). *The other three illustrated on p. 197 are represented in English, in the Scogil Scientific, Inc. documentation listed above in this IDS.*
Sigma-Aldrich Biochemicals and Reagents Catalogue; 2000-2001; p. 2506 PowerPette Plus; top right corner of page; from Google Catalogues.
Bioworld Catalogue; 2002; p. 70; Accu-jet; top right corner of page; from Google Catalogues.

* cited by examiner

PIPETTE DEVICE WITH PIVOTABLE NOZZLE ASSEMBLY

FIELD OF THE INVENTION

This invention pertains generally to a laboratory device. More particularly, this invention pertains to an adjustable pipette device for aspirating and dispensing liquids.

BACKGROUND OF THE INVENTION

Persons performing low-impact, repetitive tasks such as word processing sometimes report pain and/or discomfort in the hands, arms, and neck. Doctors now diagnose such debilitating pain and discomfort as carpal tunnel syndrome or other cumulative trauma disorder (CTD) or repetitive stress injury (RSI). Ergonomic disorders, such as the aforementioned, have spawned a multi-billion dollar industry intending to maximize worker productivity by providing comfortable workstations, chairs, and computer hardware, thereby minimizing fatigue and discomfort.

Despite the advances of ergonomics for the office environment, in a laboratory setting, such as a medical laboratory, laboratory technicians are still subjected to repetitive operations with sub-optimal ergonomic devices such as pipette devices. Pipetting is the act of aspirating and dispensing controlled volumes of liquid, and is one of the most frequently performed repetitive lab operations. Attempts to minimize the occurrences of RSIs in the lab have focused on training technicians in body mechanics (e.g., posture, pipetting technique, etc.), and providing a ergonomic pipette device.

The design of a pipette device is as important as the manner in which it is used. Pipette manufacturers recognize the benefits of an ergonomic pipette device, as is evidenced by the number of different ergonomic devices available. For example, many devices include a contoured handgrip to allow for a relaxed hold on the device. However, a contoured handgrip is not sufficient to completely obviate the development of a RSI or CTD in awkward, confined or restricted spaces, such as pipetting at lowered benchtops or in fume hoods where arm, joint or tendon strain may occur. Healthy technicians will not only have better attendance and attitude, but will also perform better with improved pipetting accuracy and precision. Therefore, in view of the foregoing, a need exists for an adjustable ergonomic pipette device.

BRIEF SUMMARY OF THE INVENTION

The invention provides a pipette device with a pivotable nozzle assembly. The pipette device includes a housing defining a device axis. The nozzle assembly includes a pivot mechanism that is rotatably engaged with the device housing. The pivot mechanism includes pivot bosses and an indexing portion. A nozzle release is retained by a portion of the device housing, and is operative to engage and disengage the indexing portion to select the pivot angle of the nozzle assembly.

DETAILED DESCRIPTION

Figure 1A:
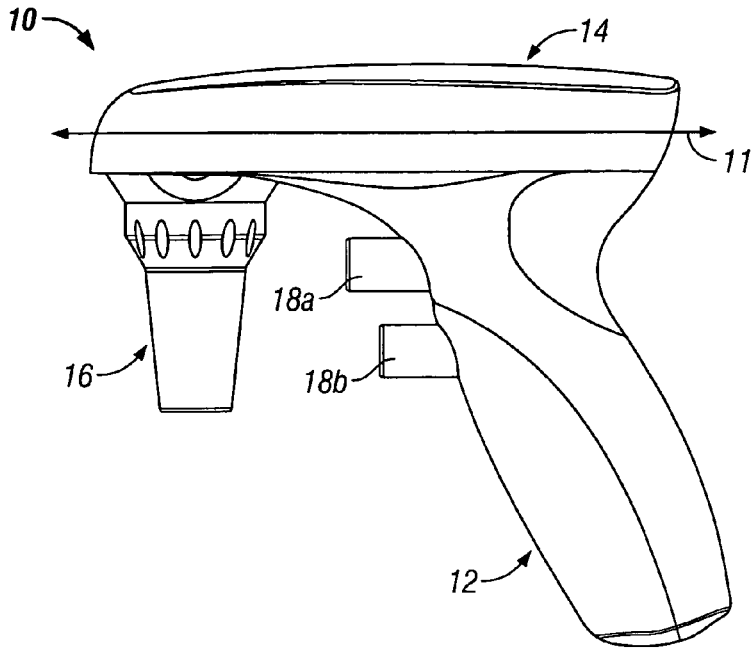
FIG. 1A shows a side elevation view of the inventive pipette device.
Figure 1B:
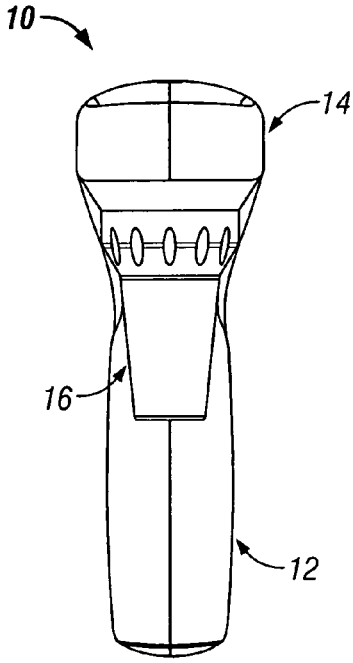
FIG. 1B shows a front elevation view of the device of FIG. 1A.
Figure 1C:
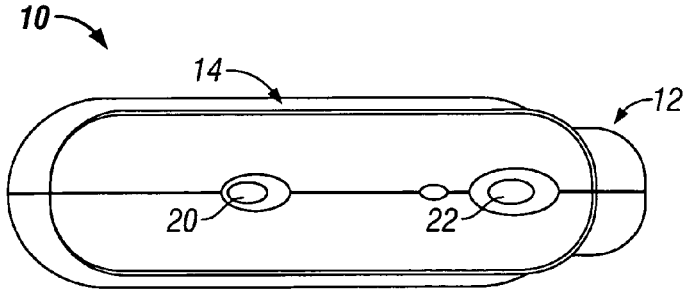
FIG. 1C shows a top view of the device of FIG. 1A.
Figure 2:
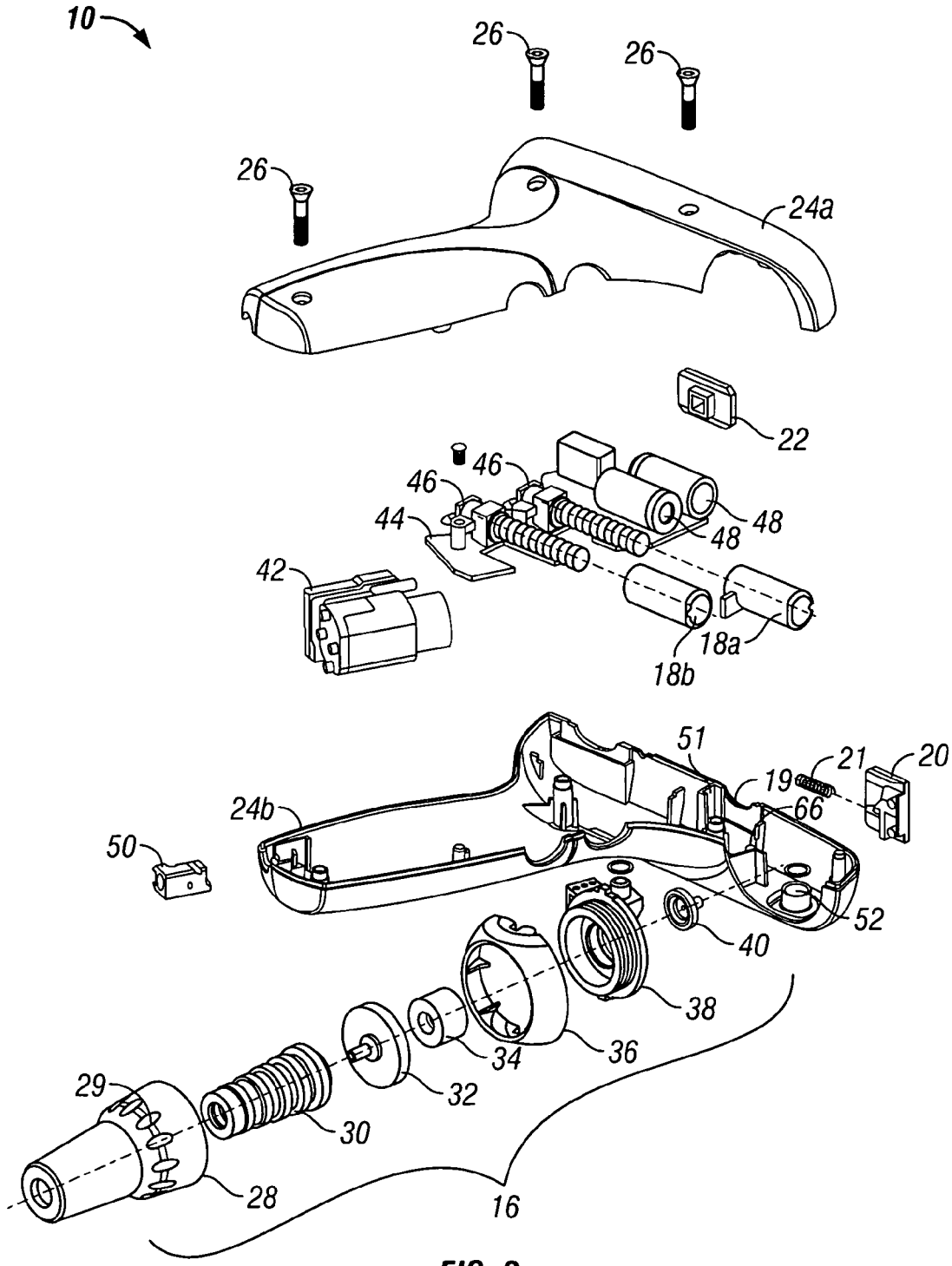
FIG. 2 shows an exploded view of the device of FIG. 1A.

Referring now to the Figures, and particularly FIGS. 1A, 1B, and 1C, one embodiment of the pipette device is shown. The illustrated embodiment of the pipette device 10 includes a generally pistol-shaped housing, although other shapes are suitable for the housing. The housing may be constructed of any suitable material known in the art, but preferably the housing is constructed of a plastic material molded or otherwise formed into two distinct halves 24*a* and 24*b* which are secured by fasteners such as screws 26 (FIG. 2). Preferably, the housing includes an external matte finish that provides a non-slip surface for improved gripping and handling of the device 10. The housing includes a handgrip portion 12, a barrel portion 14, and a nozzle assembly 16. To those in the art, such pipette devices are commonly referred to as pipette guns. During typical use of the device 10, the barrel portion 14 is oriented substantially parallel with a horizontal work surface (e.g., table, benchtop, etc.) In this way, a device axis 11 is defined through the device 10, which is generally horizontal during typical use, but may oriented otherwise for the user's comfort. The nozzle assembly 16 is operable to releasably retain glass and plastic pipettes of various sizes and volumes. Additionally, as discussed in further detail below, the nozzle assembly 16 may be pivoted away from the handgrip portion 12 to reduce arm strain during pipetting. Advantageously, the handgrip portion 12 includes an ergonomic treatment to reduce hand strain and is hand-neutral (i.e., usable by both right-handed and left-handed users).

Trigger buttons 18*a* and 18*b* are generally cylindrical and project through a portion of the handgrip portion 12. The buttons 18*a*, 18*b* are positioned for actuation by the user's fingers and may include an ergonomic treatment such as a curved, concave, or contoured end surface for reducing finger fatigue. Furthermore, the aforementioned end surface may include a button-identifying portion such as an indent or protrusion that provides a user with a means for telling the buttons apart. Buttons 18*a* and 18*b* activate the device 10 to aspirate and dispense fluid respectively as is common in the art, however the buttons 18*a* and 18*b* may alternatively dispense and aspirate fluid respectively. Referring now to FIG. 2, the buttons 18*a*, 18*b* actuate microswitches or the like (not shown) on the circuit board 44 to operate a reversible motorized pump mechanism 42, such as a vacuum pump or the like. The pump mechanism 42 applies a positive or negative pressure to an attached pipette via one of the variable valve assemblies 46 and connective flexible tubing (not shown) within the housing. A variable switch 22 is retained by a portion of the barrel portion 14 and may be linked to the circuit board 44 to select the speed of the pump mechanism 42 depending on the user's desired pipetting speed and precision. Additionally, the pump mechanism 42 is energized by one or more batteries 48, which are rechargeably linked to a power jack 50.

Figure 3A:
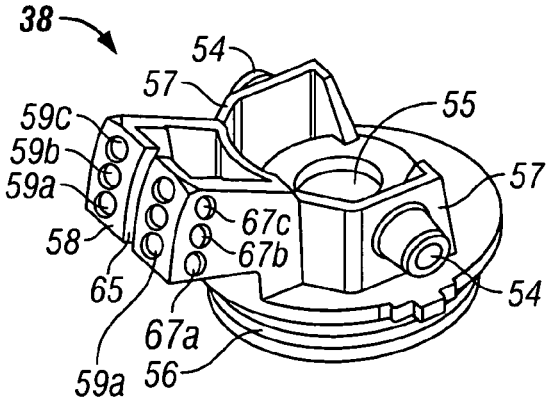
FIG. 3A shows a perspective view of the pivot mechanism shown in FIG. 2.
Figure 3B:
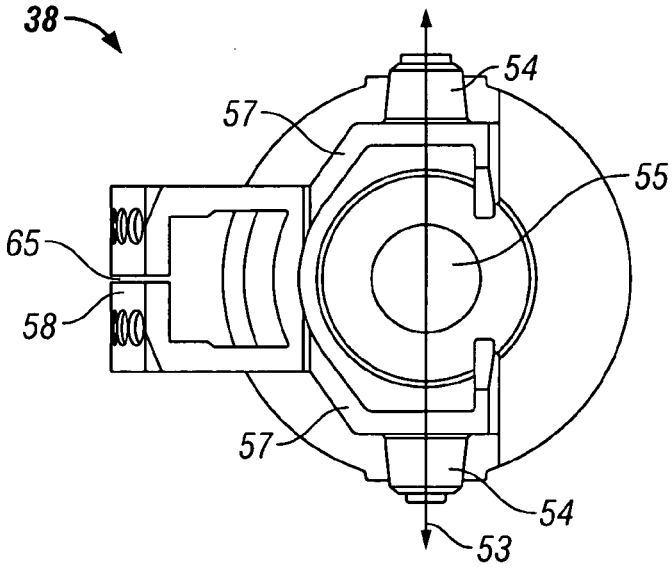
FIG. 3B shows a top view of the pivot mechanism shown in FIG. 3A.

As shown in FIG. 2, the nozzle assembly 16 includes a nozzle housing 28 with a generally frustoconical shape and central bore therethrough. The exterior of the nozzle housing 28 may include gripping detents 29 that facilitate disassembly of the nozzle assembly 16 for filter replacement, cleaning, autoclaving, or the like. To provide a continuous positive or negative pressure path between a pipette engaged to the nozzle assembly 16 and the pump mechanism 42, a number of elements are engaged within the nozzle housing 28. Disposed within the nozzle housing 28 is a pipette coupling 30 that is made of a rubber or other elastomeric material for frictionally engaging pipettes of various sizes and volumes. Also disposed within the nozzle housing 28 and sealably engaged to the pipette coupling 30 is a filter 32 for preventing aspirated fluids from entering the pump mechanism 42. A seal 34 is engaged to the upper connector of the filter 32, and is sized and shaped to plug the pivot mechanism 38 central bore 55 (FIG. 3A, 3B). A tube fitting 40 to which the connective flexible tubing attaches is inserted into the central bore 55 and is held captive therein by the seal 34. A nozzle shield 36 is affixed to the pivot mechanism 38 and is generally annular in shape. The nozzle shield 36 is sized and shaped to substantially encompass the sides of the pivot mechanism 38, yet permits access to the bottom engagement portion of the pivot mechanism 38. In this manner, the nozzle housing 28 may be affixed to the pivot mechanism 38, thereby sealing the nozzle assembly 16.

Referring now to FIGS. 3A and 3B, the pivot mechanism 38 is described in further detail. As shown, the pivot mechanism 38 is somewhat cylindrical in shape and includes a central bore 55 therethrough defining a pipetting axis. A first portion of the pivot mechanism 38 includes threads 56 that engage complementary internal threads of the nozzle housing 28. A second portion of the pivot mechanism 38 includes two diametrically opposed pivot bosses 54. As shown in FIG. 2, the pivot bosses 54 are sized and shaped to snugly fit within pivot sleeves 52 on housing halves 24*a* and 24*b*. Additionally, o-rings or the like may be disposed on the pivot bosses 54 to provide for smooth rotation of the bosses 54 in sleeves 52. The pivot bosses 54 project outwardly from an integral support structure 57 and define a pivot axis 53 about which the pivot mechanism 38 rotates and transverse to the device axis 11 (FIG. 1A). The bosses 54 may be cylindrically, frustoconically, or otherwise shaped to permit rotation, but it is preferred that the bosses 54 be frustoconically shaped to provide a more tolerant fit in the pivot sleeves 52 so that wobble of the nozzle assembly 16 relative to the barrel portion 14 is minimized. The sleeves 52 and the bosses 54 are rotatably engaged and provide a pivoting means to angle or otherwise adjustably rotate an attached pipette about the pivot axis. Although the illustrated pivot axis 53 is transverse to the device axis 11, the pivot mechanism 38 and pivot sleeves 52 may be arranged alternatively so the axes 11, 53 are oriented parallel, obliquely, or otherwise to achieve a desired pivoting of the nozzle assembly 16. Moreover, the device 10 may alternatively include, for example, a swivel, ball, joint, articulation, ball-in-socket, or other like means for providing continuous adjustability in a variety of directions of the nozzle assembly 16. Furthermore, the device 10 may include a locking means to lock, clamp, or otherwise inhibit adjustment of the swivel, ball, joint, articulation, ball-in-socket or the like so the nozzle assembly 16 may be fixedly retained in a desired position. The locking means may include, for example, a pin, screw, clamp, vise, or other fastening means known in the art.

Figure 4A:
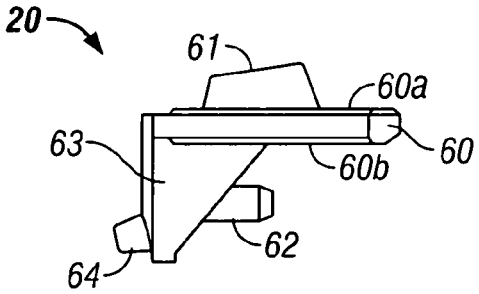
FIG. 4A shows a side elevation view of the nozzle release shown in FIG. 2.
Figure 4B:
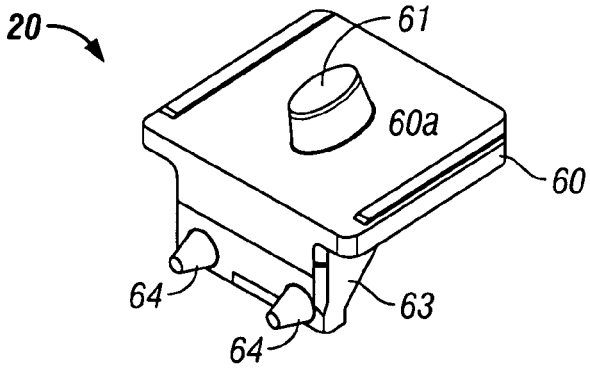
FIG. 4B shows a perspective view of the nozzle release of FIG. 4A.

Integral with the support structure 57 and spaced radially outwardly from the pivot bosses 54 is an indexing surface 58. The indexing surface 58 is slightly concave and includes a plurality of indexing holes. As shown, the indexing holes are arranged as three pairs of vertically spaced holes (59*a*, 59*b*, 59*c*), and the holes of each pair are horizontally and equally spaced apart a predetermined distance. The holes 59*a*, 59*b*, 59*c*, when engaged by a retaining member such as the nozzle release 20 of FIGS. 4A and 4B, are operative to retain the nozzle assembly 16 at predetermined angles relative to the device axis 11. For example, the bottom pair of holes 59*a* may orient the nozzle assembly 16 substantially perpendicular to the horizontal axis 11, the middle pair of holes 59*b* may orient the nozzle assembly 16 at a first outward pivot angle (i.e., away from the handgrip portion 12), and the upper pair of holes 59*c* may orient the nozzle assembly 16 at a second (and greater) outward pivot angle. Furthermore, as shown in the illustrated embodiment, the indexing surface 58 may be bisected by a channel 65, and the side portions of the support structure 57 proximate the indexing surface 58 may include indexing indents (67*a*, 67*b*, 67*c*). Inwardly projecting posts 66 within the housing halves 24*a* and 24*b* (FIG. 2) mate with the indexing indents 67*a*, 67*b*, 67*c* to provide the user with an indication that the nozzle assembly 16 is adjustably retained at one of the predetermined angles. As the nozzle assembly 16 is pivoted between predetermined angles, the posts 66 compress the halves of the bisected indexing surface 58 together. When the nozzle assembly 16 reaches a predetermined angle, the posts 66 plunge into a pair of indexing indents 67*a*, 67*b*, 67*c* making an audible and sensory "pop", and allow the halves of the bisected indexing surface 58 to decompress. Although three pairs of holes and indents are illustrated, fewer or additional pairs could be included to provide a user with fewer or additional orientations of the nozzle assembly 16.

Referring now to FIGS. 4A and 4B, the nozzle release 20 is described in further detail. The nozzle release 20 is slideably retained by a portion of the barrel 14, and is operable to select the pivot angle of the nozzle assembly 16. The nozzle release 20 is normally biased to engage the indexing holes 59*a*, 59*b*, 59*c*, thereby preventing accidental or undesired pivoting of the nozzle assembly 16 during pipetting. The nozzle release 20 includes a generally planar portion 60 with an upper side 60*a* and lower side 60*b*. An actuation projection 61 extends from the upper side 60*a* to facilitate sliding of the release 20 by a user's thumb or finger. A combination biasing and engagement portion 63 extends from the lower side 60*b* and includes a spring boss 62 and indexing nubs 64. The spring boss 62 extends rearward (toward the handgrip portion 12) and accepts a spring such as compression spring 21 as shown in FIG. 2. The release 20 is retained within an opening 19 in the housing proximate to an internal wall 51 (FIG. 2). In accordance with the size of the opening 19 and location of the wall 51 relative to the opening, the spring 21 is normally compressed against the wall 51 so that the spring force normally biases the release 20 forward (toward the nozzle assembly 16) in the opening 19. Thus, when release 20 is normally positioned in the opening 19, the indexing nubs 64 project into and releasably engage the indexing holes 59*a*, 59*b*, 59*c*.

The indexing nubs 64 and holes 59*a*, 59*b*, 59*c* provide an indexing means for effecting discrete adjustment of the pivot angle of the nozzle assembly 16 and a pipette when attached thereto. To adjust the pivot angle in accordance with the foregoing, a user may grasp the device 10 in one hand and slideably retract the release 20. With the other hand, the user may grasp the nozzle assembly 16 and pivot it to a desired orientation. When the nubs 64 of the release 20 positively engage a pair of holes 59*a*, 59*b*, 59*c*, the release 20 may spring back to its normal position in the opening 19 as the user lets go of the release 20. However, if the user lets go of the release 20 and a pair of holes 59*a*, 59*b*, 59*c* are misaligned with the nubs 64, the release 20 will remain displaced from its normal position in the opening 19, thereby providing the user with an indication of disengagement. By pivoting the nozzle assembly 16 further, the user may positively align the nubs 64 and holes 59*a*, 59*b*, 59*c* so the release 20 springs back to its normal position within the opening 19. Moreover, if the position of the release 20 in the opening 19 is indefinite, a user may wiggle or otherwise manipulate the nozzle assembly 16 to determine if the nozzle assembly 16 is at a predetermined pivot angle. In an alternative embodiment, the spring force from spring 21, which biases the release 20, may be sufficient to prevent accidental pivoting of the nozzle assembly 16, yet precludes a need for a user to manipulate the release 20 concurrently with the nozzle assembly 16.

Preferred embodiments of this invention are described herein. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A pipette device for retaining a pipette at any one of a plurality of positions relative to the device, the device comprising:

a housing including pivot sleeves;

a nozzle assembly for accepting a pipette, the nozzle assembly pivotally coupled to the housing; and a pivot selector on the housing to adjust the position of the nozzle assembly, wherein the nozzle assembly includes pivot bosses rotatably retained in the pivot sleeves and an indexing surface engageable with the pivot selector, and further wherein the indexing surface includes at least two pairs of holes, with each pair spaced from each other pair, and the indexing surface is bisected and each pair of holes further comprises a pair of indents.

2. A pipette device for retaining a pipette at any one of a plurality of positions relative to the device, the pipette device comprising:

a housing defining a device axis;

a nozzle assembly for accepting a pipette;

a pivot mechanism for pivotally coupling the nozzle assembly to the housing, the pivot mechanism having a first portion for coupling to the nozzle assembly and a second portion for pivotally coupling to the housing, the pivot mechanism defining a pivot axis about which the nozzle assembly rotates relative to the housing; and a pivot selector on the housing for retaining the nozzle assembly at a selected rotational position, wherein the second portion of the pivot mechanism comprises a pivot boss for pivotally coupling the pivot mechanism to the housing and an indexing surface engageable with the pivot selector, and further wherein the indexing surface is bisected and includes at least two pairs of indents with each pair spaced from each other pair.

3. The pipette device of claim 2 wherein the housing comprises a pivot sleeve for rotatably receiving the pivot boss of the pivot mechanism.

4. The pipette device of claim 3 wherein the pivot boss and the pivot sleeve are generally frustoconical.

5. The pipette device of claim 2 wherein the housing comprises an ergonomic grip.

6. The pipette device of claim 2, and further comprising a plurality of indexing nubs engageable with the indexing surface.

7. The pipette device of claim 2 wherein the pivot selector includes a slidable release having at least one projection for engaging the pivot mechanism, and a spring for biasing the slideable release to an engage position with the pivot mechanism.

8. The pipette device of claim 2 wherein the pivot axis is transverse to the device axis.

* * * * *